US011111441B2

(12) United States Patent
Fujimoto et al.

(10) Patent No.: US 11,111,441 B2
(45) Date of Patent: Sep. 7, 2021

(54) METHOD FOR PRODUCING FERROCOKE

(71) Applicant: JFE STEEL CORPORATION, Tokyo (JP)

(72) Inventors: Hidekazu Fujimoto, Tokyo (JP); Takashi Anyashiki, Tokyo (JP); Toru Shiozawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 159 days.

(21) Appl. No.: 15/737,567

(22) PCT Filed: Jun. 13, 2016

(86) PCT No.: PCT/JP2016/067523
§ 371 (c)(1),
(2) Date: Dec. 18, 2017

(87) PCT Pub. No.: WO2016/208435
PCT Pub. Date: Dec. 29, 2016

(65) Prior Publication Data

US 2018/0187088 A1 Jul. 5, 2018

(30) Foreign Application Priority Data

Jun. 24, 2015 (JP) ..... JP2015-126691

(51) Int. Cl.
*C10B 57/06* (2006.01)
*C10B 53/08* (2006.01)
(Continued)

(52) U.S. Cl.
CPC ..... *C10B 57/06* (2013.01); *C10B 45/02* (2013.01); *C10B 53/08* (2013.01); *C21B 5/007* (2013.01)

(58) Field of Classification Search
CPC combination set(s) only.
See application file for complete search history.

(56) References Cited

U.S. PATENT DOCUMENTS 3,663,186 A * 5/1972 Dzhaparidze ..... C10B 53/08 201/6
2012/0144734 A1 6/2012 Fujimoto et al.
2014/0144071 A1 5/2014 Dohi et al.

FOREIGN PATENT DOCUMENTS

CA 1063060 A 9/1979
CN 101910364 A 12/2010
(Continued)

OTHER PUBLICATIONS

Chemical Engineeriog (Oct. 1, 2017), https://www.chemengonline.com/ferro-coke-utilization-promises-reduce-energy-consumption-ironmaking/.*
(Continued)

*Primary Examiner* — Prem C Singh
*Assistant Examiner* — Chantel L Graham
(74) *Attorney, Agent, or Firm* — Oliff PLC

(57) ABSTRACT

A method for producing ferrocoke in which it is possible to use a cheap and poor-quality coal having a high ash content while suppressing the decrease of the strength in ferrocoke or formed coke and a special coal mixing is not performed with respect to the fusion frequently causing problems in the carbonization with the shaft furnace. In a method for producing ferrocoke by molding and carbonizing a mixture of coal and iron ore, the coal is a single coal or a mixture of plural coals and a non-caking or slight caking coal having a load average value of ash content of not less than 10.7% and a load average value of mean maximum reflectance of not less than 0.81% is used.

2 Claims, 6 Drawing Sheets

(51) Int. Cl.
*C10B 45/02* (2006.01)
*C21B 5/00* (2006.01)

(56) References Cited

FOREIGN PATENT DOCUMENTS

| | | | | |
|---|---|---|---|---|
| CN | 102498190 | A | | 6/2012 |
| CN | 102782095 | A | | 11/2012 |
| CN | 104119939 | A | | 10/2014 |
| EP | 2 233 548 | A1 | | 9/2010 |
| EP | 2 543 716 | A1 | | 1/2013 |
| JP | S56-125491 | A | | 10/1981 |
| JP | S60-35094 | A | | 2/1985 |
| JP | S60-110785 | A | | 6/1985 |
| JP | 2005-015701 | A | | 1/2005 |
| JP | 2008-056791 | A | * | 3/2008 |
| JP | 5017969 | B2 | | 9/2012 |
| JP | 2013-237876 | A | | 11/2013 |

OTHER PUBLICATIONS

May 4, 2018 Extended European Search Report issued in European Patent Application No. 16814206.5.
Jul. 5, 2016 Search Report issued in International Patent Application No. PCT/JP2016/067523.
"Chemistry and Technology of Coal." The Japan Institute of Energy, p. 9, 2013.
"Chemistry and Technology of Coal." The Japan Institute of Energy, p. 51, 2013.
Nov. 9, 2018 Office Action issued in Korean Patent Application No. 10-2017-7036512.
Sep. 5, 2019 Office Action issued in Chinese Patent Application No. 201680035937.X.

* cited by examiner

METHOD FOR PRODUCING FERROCOKE

TECHNICAL FIELD

This invention relates to a method for producing ferrocoke by molding and carbonizing a mixture of coal and iron ore.

RELATED ART

As a function of chamber oven coke is mentioned a securement of air permeability in a packed bed inside a blast furnace. In order to ensure the air permeability, it is necessary that coke is hardly pulverized during the unloading inside the blast furnace, and hence it is required to produce a high-strength coke.

Heretofore, many examinations on the mixing theory of coal have been performed for the production of the high-strength coke. In the site of producing coke is performed the mixing of coals so as to attain a maximum reflectance (Ro) of about 1.2% and a maximum fluidity (MF) of about 200-1000 ddpm (Non-patent Document 1). High-quality coals having a low ash content and a high caking property are used for metallurgical coke. In Non-patent Document 2, however, a reserve-production ratio of coal is said to be 112 years. In the case of the chamber oven coke, it is considered to further decrease the reserve-production ratio.

To this end, it is considered that the use of coals having a high ash content should be assumed for the future. However, when the high ash content coal is used as a raw material for coke, there is a fear of decreasing a coke yield and decreasing a coke strength associated with the decrease of MF of coal. Therefore, many methods for removing ash from the high ash content coal have been proposed since early times. For example, there are an oil agglomeration method (Patent Document 1), a floatation method (Patent Document 2) and so on.

Recently, the use of ferrocoke obtained by molding and decarburizing a mixture of coal and iron ore is noticed as a partial substitute of the chamber oven coke from a viewpoint of foresight to global environment. In the case of using an exclusive shaft furnace for the production of ferrocoke, if the mixing of coals is mistaken, fusion between mutual molded products is caused in the shaft furnace and hence a risk of causing impossibility of operation becomes high. To this end, the mixing of a hardly softening coal is considered for suppressing the fusion between the mutual molded products in the production of ferrocoke (Patent Document 3).

PRIOR ART DOCUMENTS

Patent Document

Patent Document 1: JP-A-556-125491
Patent Document 2: JP-A-560-35094
Patent Document 3: Japanese Patent No. 5017969

Non-Patent Documents

Non-patent Document 1: The Japan Institute of Energy, "Chemistry and Technology of Coal", 2013, p. 51
Non-patent Document 2: The Japan Institute of Energy, "Chemistry and Technology of Coal", 2013, p. 9

SUMMARY OF THE INVENTION

Task to be Solved by the Invention

Since the chamber oven coke is charged into a coke oven by gravity charging of coal, a distance between coal particles is large. Therefore, coals having fluidity during the carbonization and certain expandability are desirable as coal for the chamber oven. When the high ash content coal is used for the chamber oven coke, the fluidity of the coal is decreased, so that the use of the high ash content coal is limited. When various ash-removing methods are applied to the high ash content coal, the removal of ash is frequently good, but the cost of manufacturing coke is largely increased. In the removal of ash, it is assumed that carbonaceous matter and an ash are freely separated from each other, so that the above method is applied only to finely divided coals if it is intended to largely increase the ash removing ratio.

In the process of molding coal exemplified by ferrocoke or briquette, a product obtained by compression-molding coal is charged into an exclusive shaft furnace or chamber oven coke and then carbonized therein. The fluidity of coal may be lower than that of the coal for chamber oven coke because of compression molding. When the high ash content coal is used for the production of ferrocoke or briquette, the necessity for previously reinforcing the ash removal is low, so that the increase of the cost for manufacturing coke is avoided. However, coke having a high ash content is charged into a blast furnace, so that there is a fear of causing a bad influence such as increase of fuel consumption rate of furnace or the like. Since ferrocoke or formed coke is positioned as an auxiliary material for the chamber oven coke, the amount of ferrocoke or formed coke used as a raw material for the blast furnace is small as compared to the chamber oven coke. To this end, it is possible to reduce the bad influence by ash derived from ferrocoke or formed coke by adjusting the ash content of the chamber oven coke.

In the ferrocoke or the formed coke, it is usual to perform carbonization with the shaft furnace, but a fear of fusing the mutual molded products during the carbonization is caused. Accordingly, it is necessary to mix coals for preventing the fusion, but a demerit of restricting brands is caused. Since the coal having a high ash content lowers the expandability of coal, there is a possibility of avoiding the fusion associated with the expansion of coal.

It is, therefore, an object of the invention to propose a method for producing ferrocoke in which it is possible to use a cheap and poor-quality coal having a high ash content while suppressing the decrease of the strength in ferrocoke or formed coke and a special coal mixing is not performed with respect to the fusion frequently causing problems in the carbonization with the shaft furnace.

Solution for Task

The inventors have made various studies on the problems inherent to the above conventional techniques and found out that the use of the cheap and poor-quality coal having a high ash content is made possible by applying the high ash content coal to the process for ferrocoke or formed coke associated with compression molding while suppressing the decrease of the strength in the ferrocoke or formed coke and hence the special coal mixing is not performed with respect to the fusion frequently causing problems in the carbonization with the shaft furnace, and as a result the invention has been accomplished.

The invention is a method for producing ferrocoke by molding and carbonizing a mixture of coal and iron ore, characterized in that the coal is a single coal or a mixture of plural coals and a non-caking or slight caking coal having a load average value of ash content of not less than 10.7% and a load average value of mean maximum reflectance of not less than 0.81% is used.

Here, the maximum reflectance can be measured according to JIS M8816

In the production method of ferrocoke having the above construction according to the invention, it is considered that (1) the compression molding is conducted at a density of not less than 1400 kg/m$^3$ in the molding of the mixture of coal and iron ore is a preferable solving means.

Effect of the Invention

According to the invention having the above construction, the non-caking or slight caking coal is used as a single coal or a coal mixture having a predetermined ash content and a predetermined mean maximum reflectance, whereby ferrocoke having a high strength can be obtained while avoiding fusion between mutual molder products during the carbonization.

EMBODIMENTS FOR CARRYING OUT THE INVENTION

The inventors have made various studies and found that it is possible to attain a target strength even in ferrocoke having a high ash content by restricting an average maximum reflectance range of a high ash content coal having an ash content of not less than 10.7%. Also, it has been found that the use of the high ash content coal having an ash content of not less than 10.7% forms a coal having no fear of causing fusion between mutual molder products and hence fusion is suppressed without considering a special mixing. Thus the invention has been accomplished.

Each constitutional component used in the production method of ferrocoke according to the invention will be described below and also a relation between the each constitutional component and ferrocoke strength will be described.

Figure 1:
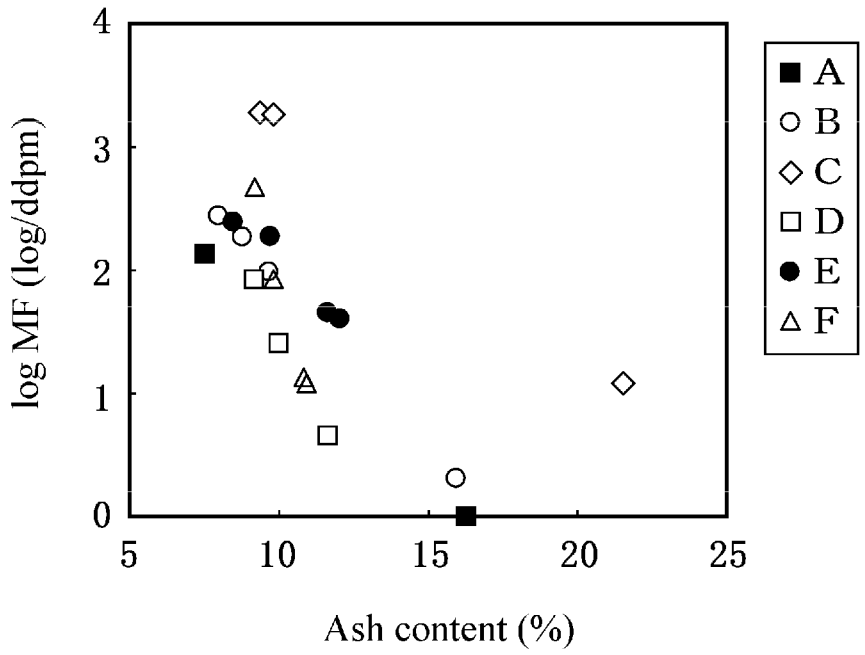
FIG. 1 is a graph showing a relation between ash content and maximum fluidity (MF) of coal.

An ash content of coal defined in the invention is measured according to JIS M8818 and represented by a value based on a dry weight. FIG. 1 shows results of maximum fluidity (MF) measured on coals having different ash contents obtained by varying a cleaning degree of coal and non-cleaning coals. MF is measured according to JIS M8801. In either coal, MF of coal is decreased as the ash content of coal is increased. It can be seen that in the ash content of not more than 10%, log MF is 2-3.3 (log/ddpm), while when the ash content is not less than 10.7%, log MF is decreased to not more than 1.5 (log/ddpm).

Figure 2:
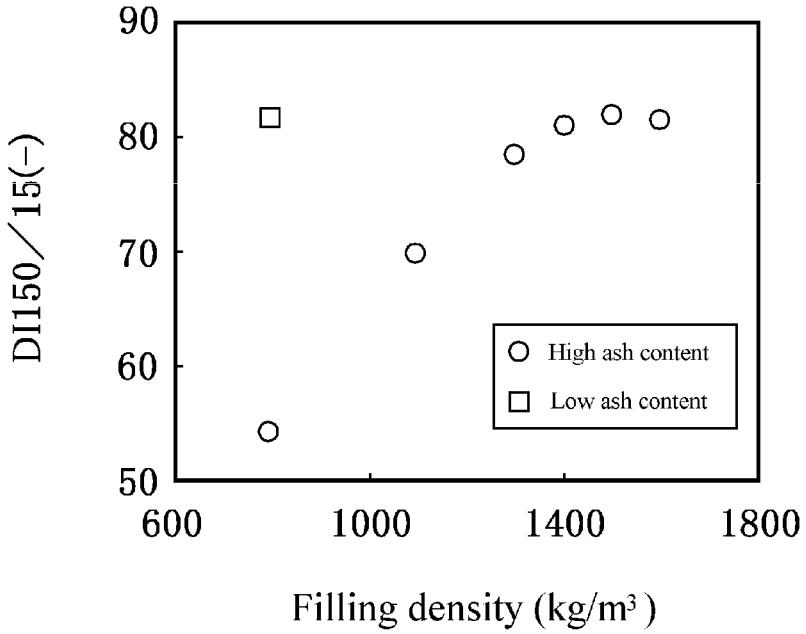
FIG. 2 is a graph showing a relation between filling density of coal and coke strength.

As to coals having a high ash content, FIG. 2 shows carbonization results obtained by changing a filling density of coal. As a raw material, iron ore is mixed with coal at an amount corresponding to 30 mass % of the raw material. An ash content of a high ash content coal is 16%. As a test object is also used a low ash content coal having an ash content of 8%. A filling density is adjusted by charging 15 kg of a raw material composed of pulverized coal and iron ore into a carbonization vessel of 400 mm square and 600 mm height and compressing the charged mass. The carbonization is conducted according to the following laboratory-scale carbonization process. The carbonization vessel is charged into a carbonization furnace, held at a furnace wall temperature of 1000° C. for 6 hours and cooled in a nitrogen atmosphere. A carbonized product cooled to room temperature is taken out to measure a strength. The strength is evaluated by a drum strength (DI 150/15). DI 150/15 is a drum strength obtained by measuring a mass ratio of coke having a particle size of not less than 15 mm under conditions of 15 rpm and 150 revolutions by a rotation strength test method of JIS K2151. In the case of the low ash content coal, high-strength ferrocoke can be produced even in an apparent density of 800 kg/m$^3$. In the case of the high ash content coal, however, if the filling density is low, the ferrocoke strength is lower than that in the use of the low ash content coal. As the filling density is increased, the ferrocoke strength is increased, from which it can be seen that the filling density of not less than 1400 kg/m$^3$ is required for increasing the coke strength.

The production method of ferrocoke according to the invention is obtained according to the following test procedure. There are provided high ash content coals having an ash content of 10.7%-23.5%, and a binder is added to a mixture of iron ore and a single coal or a coal mixture to perform kneading and molding. The molded product is carbonized in a laboratory type carbonization furnace. The carbonized material is cooled in $N_2$ atmosphere to measure ferrocoke strength. The quality of coals used (single coal) is shown in Table 1. The iron ore used has a total iron content of 57 mass %. The pulverized particle size of each of coal and iron ore is not more than 2 mm in full dosage.

TABLE 1

| Brand | Ash content (%) | Ro (%) | log MF |
|---|---|---|---|
| a | 11.7 | 0.53 | 0.3 |
| b | 15.4 | 0.59 | 0.8 |
| c | 12.8 | 0.66 | 1.1 |
| d | 10.9 | 0.69 | 1.1 |
| e | 10.7 | 0.71 | 1.9 |
| f | 16.5 | 0.78 | 1.6 |
| g | 15.6 | 0.83 | 1.2 |
| h | 18.4 | 0.90 | 1.1 |
| i | 11.0 | 0.93 | 0.6 |
| j | 23.5 | 0.97 | 1.1 |
| k | 16.8 | 1.07 | 0.8 |
| l | 15.9 | 1.15 | 0.3 |
| m | 17.8 | 1.27 | 0.6 |
| n | 13.8 | 1.41 | 0.3 |
| o | 13.3 | 1.61 | 0.0 |

The mold is conducted as follows. The coal, iron ore and binder are mixed at a mixing ratio of 65.8 mass %, 28.2 mass % and 6 mass % with respect to the total weight of the raw material, respectively. As the coal is used a coal mixture of 2-4 brands. When the mixing ratio of iron ore is not more than 28.2 mass %, the reactivity of ferrocoke is lowered, while when it exceeds the above value, the improvement of the reactivity is small and the ferrocoke strength is largely decreased. From these facts, the mixing ratio of iron ore is determined. The raw material is kneaded in a high-speed mixer at 140-160° C. for about 2 minutes. The kneaded material is shaped into briquettes in a double roll type molding machine. A size of the roll is 650 mmϕ×104 mm, and the molding is performed at a circumferential rate of 0.2 m/s and a linear pressure of 4-5 t/cm. The molded product has a size of 30 mm×25 mm×18 mm (6 cc) and has an egg-shaped form. An apparent density of the molded product is about 1550 kg/m$^3$.

The carbonization of the molded product is conducted by a laboratory scale carbonization process (fixed layer). 3 kg of the molded product is filled in a carbonization vessel of 300 mm square and 400 mm height at a furnace wall temperature of 1000° C. for 6 hours and cooled in a nitrogen atmosphere. The carbonized product cooled to room temperature is taken out to measure a strength. The strength is evaluated by a drum strength (DI 150/15). DI 150/15 is a drum strength obtained by measuring a mass ratio of coke having a particle size of not less than 15 mm under conditions of 15 rpm and 150 revolutions by a rotation strength test method of JIS K2151. A target strength is not less than 82. When the ferrocoke is used in a blast furnace, if the strength is low, there is caused a bad influence on operation due to the pulverization in the upper part of the furnace. Therefore, the target strength of DI 150/15 is frequently not less than 85 in the usual chamber oven coke. On the other hand, ferrocoke is charged into the blast furnace for actively reacting with $CO_2$ gas inside the blast furnace to increase the generation of CO gas reducing the iron ore. The charging of ferrocoke does not purpose the securement of air permeability inside the blast furnace as in the chamber oven coke. To this end, the target strength can be set to a value lower than that of the chamber oven coke, so that the target strength is set to 82.

Figure 3:
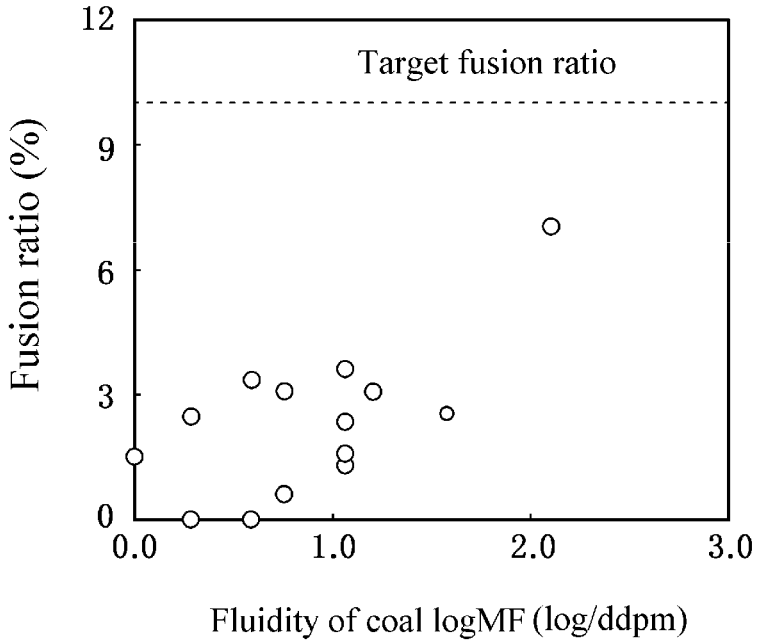
FIG. 3 is a graph showing a relation between fluidity of coal and fusion ratio.

A fusion ratio is measured in ferrocoke obtained by carbonizing a molded product made from a mixture of a single coal and iron ore. The fusion ratio means a mass ratio of ferrocoke fused in total mass of ferrocoke produced. When the fusion ratio is 10%, it can be seen that ferrocoke is discharged in a continuous carbonization furnace shown later by a bench scale without troubles, so that the upper limit of the fusion ratio is 10% in a laboratory scale carbonization test. The results of the fusion ratio are shown in FIG. 3.

As MF of coal is increased, the fusion ratio is increased. However, the fusion ratio is 7%, which is lower than the upper limit, even in the e coal having log MF of 2.1 (log/ddpm). In the case of the high ash content coals, log MF is not increased and the fusion trouble is avoided at least in the value of not more than 2.1 (log/ddpm). When the low ash content coal having an ash content of less than 10.7% is used as a starting material for ferrocoke, the fusion during the carbonization comes into problem, so that it is necessary to add a hardly softening coal as described in Patent Document 3, and hence the mixing is restricted. However, when coals having an ash content of not less than 10.7% are used, they are coal preventing the fusion, so that it is clear that it is not required to consider mixing for suppressing the fusion.

As to the upper limit of the fusion ratio, there can be considered a minimum fusion ratio causing impossibility of discharge due to shelf hanging in the carbonization furnace, so that it is considered that the shelf hanging is hardly caused in a pilot facility of a scale larger than a bench scale or an actual installation and hence the upper limit of the fusion ratio can be supposed to be a value larger than 10%. Therefore, the examination on the mixing for suppressing the fusion can be generally evaluated.

Figure 4:
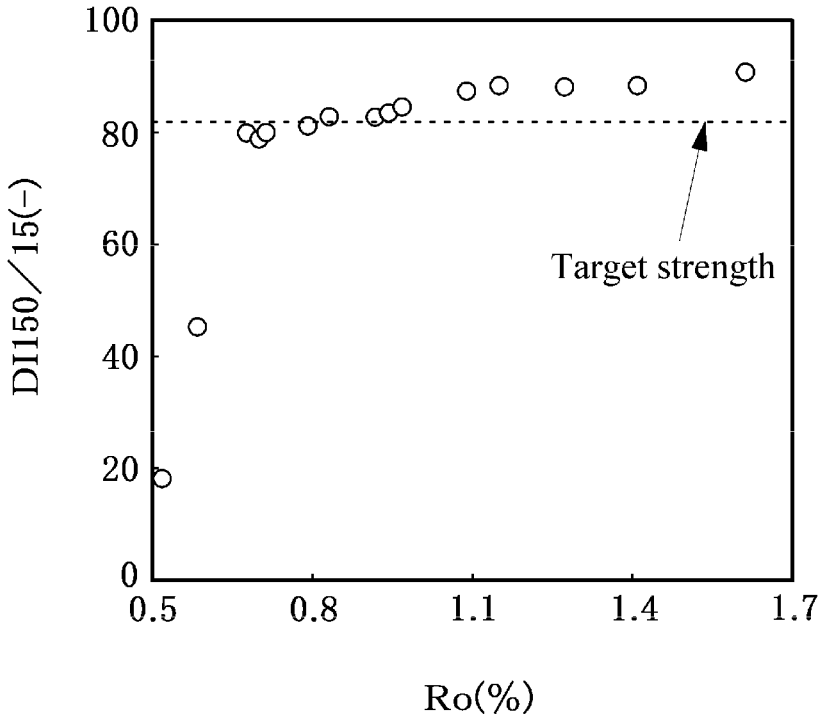
FIG. 4 is a graph showing a relation between Ro of each coal brand and ferrocoke strength.

A relation between Ro of each coal brand and ferrocoke strength is shown in FIG. 4. It can be seen that the strength is violently decreased when a load mean value of Ro is not more than 0.66%. The ferrocoke strength is largely dependent on Ro and is said to be small in the MF dependency. When the target value of the strength is not less than 82 as DI 150/15, Ro of coal is necessary to be not less than 0.83%. In the case of using only coal having a low Ro, it is guessed that the volatile matter in the coal becomes large and the porosity of ferrocoke is increased and the strength of the matrix is decreased. This is remarkable in Ro of not more than 0.06%.

Figure 5:
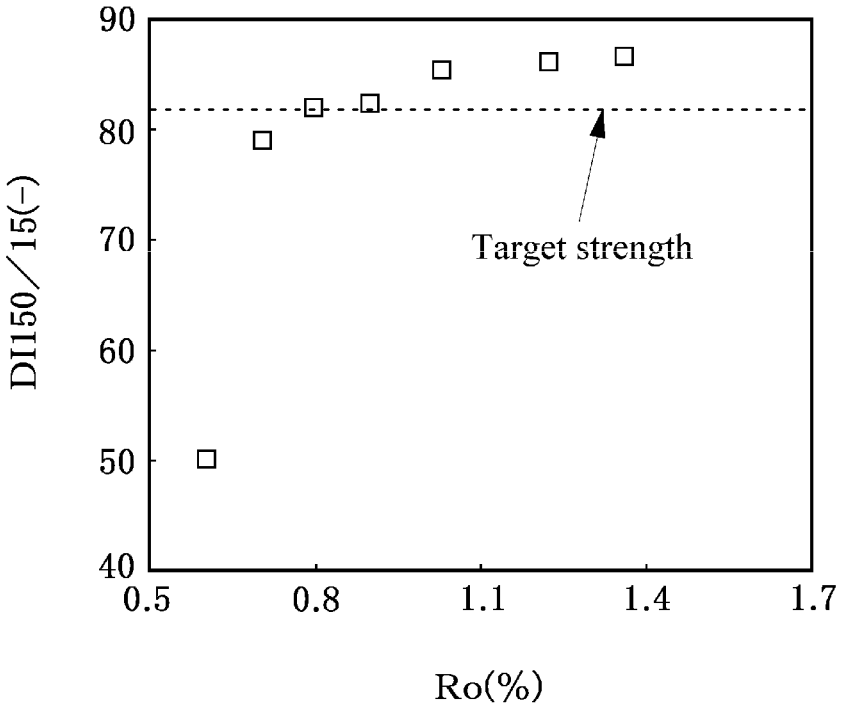
FIG. 5 is a graph showing a relation between Ro of a mixed coal brand and ferrocoke strength.

Next, coals of four brands are selected from Table 1 and mixed at a mixing ratio of 25%, which are molded and carbonized in a laboratory. Ro of the coal mixture is calculated from a load mean value of Ro in the brands. In this test, Ro of the coal mixture is set to 0.62, 0.71, 0.81, 0.91, 1.03, 1.23 and 1.36%. In the test are used a/b/c/d coals, c/d/e/f coals, e/f/g/h coals, g/h/i/j coals, i/j/k/l coals, k/l/m/n coals, and l/m/n/o coals, respectively. The results are shown in FIG. 5. The same tendency as in the result of the single coal in FIG. 4 is recognized, in which the ferrocoke strength is interrelated to Ro of the coal mixture and the strength exceeds the target value when Ro is not less than 0.81%. The fusion ratio of ferrocoke made from the coal mixture is not more than 3% and the fusion is hardly observed.

In the above example of the coal mixtures, the coals of brands having values relatively close to Ro are mixed. When coals are mixed in the production of coke, it is usual to perform the mixing of brands having wider values of Ro, so that there is no problem even if brands having wider values of Ro are mixed in the production of ferrocoke.

EXAMPLE

In this example, coal, iron ore and binder are mixed at a mixing ratio of 65.8 mass %, 28.2 mass % and 6 mass % per a total weight of a raw material, respectively. The coal is selected from Table 1. Ro of the coal mixture is set to 0.71, 0.81 or 0.91%, which is prepared from a coal mixture of c/d/e/f coals, e/f/g/h coals or g/h/i/j coals, respectively.

Figure 6:
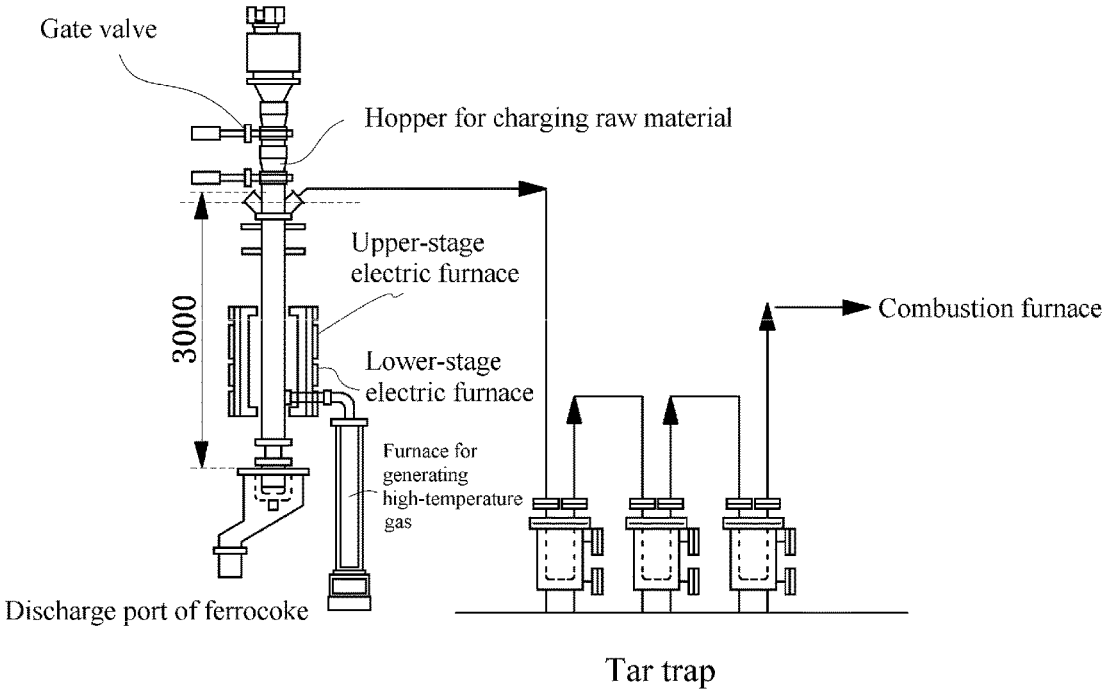
FIG. 6 is a schematic view of a vertical type carbonization furnace.

In the carbonization test is used a vertical type carbonization furnace of 0.3 t/d shown in FIG. 6. It is a continuously countercurrent flow type furnace made of SUS having a size of 0.25 meters in diameter and 3 meters in height and provided with a cooling equipment of a gas generated. Thermocouples are disposed at an interval of about 10-20 cm in a center of a reaction tube from a furnace top toward a cooling zone in a furnace bottom to determine heating conditions for forming a predetermined heat pattern. In this example, an upper-stage electric furnace is set to 700° C., and a lower-stage electric furnace is set to 850° C., and further a high-temperature gas of 850° C. is flown from a bottom of the furnace at a flow rate of 60 L/min. A maximum arriving temperature in the center of the reaction tube is 852° C. and a holding time at this temperature is about 60 minutes. The molded product is charged from the furnace top to the inside of the furnace through a dual valve, while the carbonized ferrocoke is continuously discharged from the lower part of the furnace. The ferrocoke discharged at an interval of 30 minutes is taken out to measure a strength.

Figure 7:
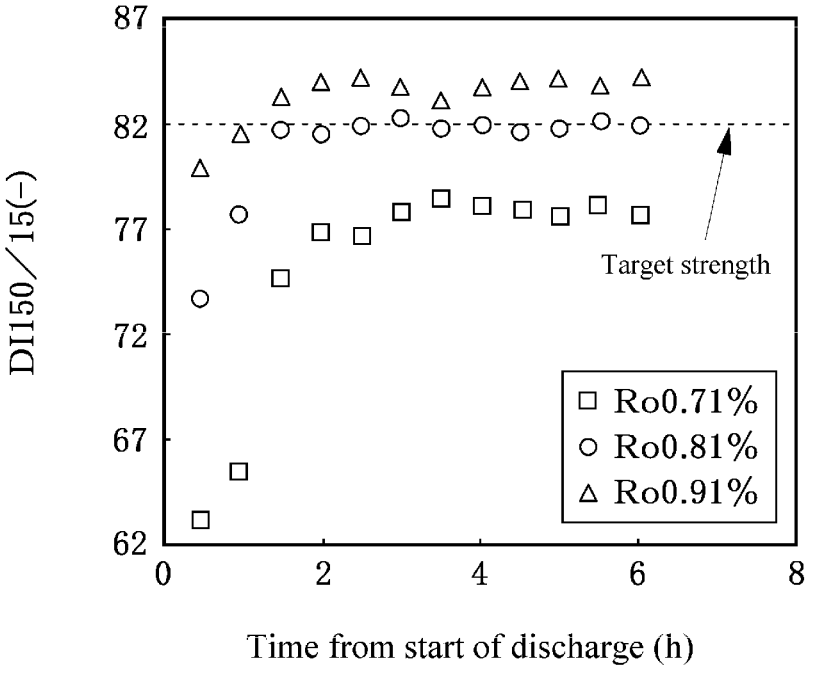
FIG. 7 is a graph showing a change of ferrocoke strength with the lapse of time.

The measured results of the strength are shown in FIG. 7. The following can be seen from the results of FIG. 7. At first, the carbonized material is discharged from the start of discharge to 2 hours under a condition that the carbonizing temperature of the molded product is not sufficient, so that the ferrocoke strength is low. However, each ferrocoke is steady with the lapse of 1.5-2 hours from the start of the discharge. When Ro of the coal mixture is 0.81 or 0.91%, the target strength is stably held in not less than 2 hours from the start of the discharge. In case that Ro of the coal mixture is 0.71%, the strength becomes constant at a state of lower than the target value.

INDUSTRIAL APPLICABILITY

According to the production method of ferrocoke according to the invention, cheap ferrocoke having a high reactivity can be produced even when a poor quality and high ash content coal is used as a starting material, while it is possible to operate a blast furnace in a low reduction material ratio.

The invention claimed is:

1. A method for producing ferrocoke comprising molding and carbonizing a mixture of coal and iron ore, wherein the coal is (i) a single coal having a load average value of ash content of not less than 10.7% and a load average value of mean maximum reflectance of not less than 0.81%, or (ii) a mixture of plural coals and a non-caking or slight caking coal, the mixture having a load average value of ash content of not less than 10.7% and a load average value of mean maximum reflectance of not less than 0.81%.

2. The method for producing ferrocoke according to claim 1, wherein molding of the mixture of coal and iron ore includes compression molding conducted at a density of not less than 1400 $kg/m^3$.

* * * * *